US012082635B2

(12) United States Patent
Bolker

(10) Patent No.: US 12,082,635 B2
(45) **Date of Patent: *Sep. 10, 2024**

(54) GARMENT WITH CELL PHONE POCKETS

(71) Applicant: Cynthia Bolker, Del Mar, CA (US)

(72) Inventor: Cynthia Bolker, Del Mar, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/371,783

(22) Filed: Sep. 22, 2023

(65) Prior Publication Data

US 2024/0008572 A1 Jan. 11, 2024

Related U.S. Application Data

(63) Continuation of application No. 18/081,581, filed on Dec. 14, 2022, now Pat. No. 11,819,073, which is a (Continued)

(51) Int. Cl.

| | |
|---|---|
| ***A41D 27/20*** | (2006.01) |
| ***A41B 9/00*** | (2006.01) |
| ***A41D 1/00*** | (2018.01) |
| *A41B 9/14* | (2006.01) |
| *A41D 1/06* | (2006.01) |

(52) U.S. Cl.

CPC ..... *A41D 27/205* (2013.01); *A41B 9/001* (2013.01); *A41D 1/002* (2013.01); *A41B 9/14* (2013.01); *A41D 1/06* (2013.01); *A41D 2300/22* (2013.01); *A41D 2300/33* (2013.01); *A41D 2600/10* (2013.01)

(58) Field of Classification Search

CPC ..... A41D 1/002; A41D 1/08; A41D 1/089; A41D 27/205; A41D 27/08; A41D 27/20; A41D 27/24; A41D 27/00; A41D 2600/10; A41D 9/001; A41D 9/04; A41F 9/00

See application file for complete search history.

(56) References Cited

U.S. PATENT DOCUMENTS 1,529,154 A * 3/1925 Block ..... A41D 27/20 2/253
2,498,048 A * 2/1950 Neinken ..... A41D 27/201 D2/857

(Continued)

FOREIGN PATENT DOCUMENTS

WO 2012135215 A1 10/2012

*Primary Examiner* — Jillian K Pierorazio
(74) *Attorney, Agent, or Firm* — FisherBroyles LLP; James P. Cleary

(57) ABSTRACT

This invention is directed toward a garment that is comfortable to wear andcan safely, with easy accessibility, securely store a cell phone and other important items. A preferred embodiment of the invention is a pair of shorts, with an elasticized waistband that can be tightened by a non-elasticized drawstring cord. There is a seamless, knitted inner layer similar to "boy short" style underwear. This seamless, knitted "boy short" style underwear inner layer provides comfort to the user. Two vertical side hip interior pockets are sewn to the inner layer at the outside of the seamless,knitted "boy short" underwear at the hips of the user, making it comfortablefor a user to carry a cell phone and/or other items. The shorts have a thin line of reflective fabric on the seams and hem of the shorts, providing safety for the user.

20 Claims, 9 Drawing Sheets

Related U.S. Application Data continuation of application No. 16/425,066, filed on May 29, 2019, now Pat. No. 11,547,162.

(60) Provisional application No. 62/683,941, filed on Jun. 12, 2018.

(56) References Cited

U.S. PATENT DOCUMENTS 2,544,840 A * 3/1951 Kowatsch ..... A41D 7/005 2/67
3,248,739 A 5/1966 Linden
4,499,612 A 2/1985 Koike
5,598,586 A * 2/1997 Munjone ..... A41D 1/08 2/237
5,649,328 A * 7/1997 Martin ..... A41D 13/0537 2/238
6,041,441 A * 3/2000 Counts ..... A41D 13/0575 450/150
6,041,442 A * 3/2000 Owen ..... A41D 1/089 2/238
6,145,132 A * 11/2000 Towner ..... A41B 9/02 2/400
6,151,735 A 11/2000 Koby et al.
8,745,768 B1 6/2014 Moghaddas
10,463,085 B2 11/2019 Mcgargill
10,645,985 B2 5/2020 Lomax et al.
10,674,777 B2 6/2020 Fisher
11,517,059 B2 12/2022 Bolker
11,547,162 B2 1/2023 Bolker
2004/0040068 A1* 3/2004 Silver ..... A41D 15/002 2/227
2006/0150302 A1* 7/2006 Warren ..... A41B 9/001 2/400
2010/0281595 A1* 11/2010 Gernes ..... A41B 9/001 2/69
2013/0014311 A1* 1/2013 Chapuis ..... A41D 27/00 2/69
2013/0091619 A1* 4/2013 Hacker ..... A41D 1/08 2/228
2014/0259297 A1* 9/2014 Garabedian ..... A41D 27/207 2/250
2015/0074871 A1* 3/2015 Emich ..... A41D 27/20 2/228
2015/0082516 A1 3/2015 Doan
2015/0196066 A1* 7/2015 Emanuel ..... A41D 31/30 424/630
2015/0359273 A1 12/2015 Olson
2016/0007662 A1* 1/2016 Powell ..... A41D 1/089 2/228
2016/0095367 A1 4/2016 Curran
2016/0095372 A1* 4/2016 Peterson ..... A41D 27/204 2/248
2016/0331053 A1* 11/2016 Gordon ..... A41D 7/00
2017/0258158 A1 9/2017 Baiany
2017/0318864 A1 11/2017 Carroll et al.
2017/0325531 A1* 11/2017 Lomax ..... A41F 1/02
2017/0354192 A1* 12/2017 Albano ..... A41D 27/207
2018/0070654 A1 3/2018 Mcgargill
2018/0116315 A1* 5/2018 Cherry ..... A63B 47/001
2018/0228232 A1* 8/2018 Fisher ..... A41D 27/20
2019/0150521 A1 5/2019 Pai
2019/0159537 A1* 5/2019 Blythe ..... A41D 27/205
2019/0174846 A1 7/2019 Puzzo et al.
2019/0297972 A1 10/2019 Holmes
2019/0320747 A1* 10/2019 Otashevich ..... A41D 31/04
2019/0373969 A1 12/2019 Bolker
2019/0373970 A1 12/2019 Bolker
2020/0214377 A1* 7/2020 Horbatuck ..... A41D 7/00
2020/0229516 A1 7/2020 Curran

* cited by examiner

GARMENT WITH CELL PHONE POCKETS

CROSS-REFERENCES TO RELATED APPLICATIONS

This application is a continuation of U.S. patent application Ser. No. 18/081,581, filed on Dec. 14, 2022 and entitled "GARMENT WITH CELL PHONE POCKETS", which is a continuation of U.S. patent application Ser. No. 16/425,066, filed on May 29, 2019 and entitled "GARMENT WITH CELL PHONE POCKETS," which claims priority to U.S. Provisional Application No. 62/683,941, filed Jun. 12. 2018 and "GARMENT WITH CELL PHONE POCKETS," the contents of each which are hereby incorporated by reference.

BACKGROUND OF THE INVENTION

Field of the invention: This invention relates to the general field of clothing, and more specifically, to pair of pants, shorts or Capris with a specific design and the ability to comfortably, safely, and with easy accessibility carry a cell phone and other items, such as, but not limited to, a medical device, small wallet, keys, ID, energy bars, cash, and/or credit card. In a particularly preferred embodiment, a pair of shorts, Capris or pants with enhanced comfort and cell phone carrying abilities is described in this application, but the materials and methods laid out in this application could just as easily apply to other items of clothing worn by women, men, or children.

BRIEF SUMMARY OF THE INVENTION

As discussed above, a particularly preferred embodiment of the invention are the utilitarian features of a comfortable, stylish and yet functional short, pant or Capri. To provide comfort, the shorts, pants or Capri have an elasticized waistband with an interior, non-elasticized drawstring cord, so users can comfortably slip on the shorts, pants or Capris, and tie them more securely, if and when needed, by tightening the non-elasticized drawstring cord. Inside of the shorts, pants or Capris is what is commonly known as, built-in seamless "boy short" style underwear, which is comprised of a snug fitting piece of fabric that extends from the waist to the intersection between the legs and the body of the wearer. This seamless "boy short" style underwear provides an inner layer of privacy and comfort, and yet because it ends at the top of the legs of the wearer, it does not bunch up, stretch out or cause chafing, as can be the case with inner garments that extend down the legs of the user. The inner layer is knitted on a machine that creates a seamless inner layer, which adds to the comfort of the user.

Since it is anticipated that this short, pant or Capri will be used by exercisers, walkers, joggers, golfers, hikers, travelers, sportspeople, athletes and runners who often will be in close proximity to roads, an attractive yet effective strip of reflective fabric is sewn onto the seams along the sides of the shorts, pants or Capris and around the hem, which can be straight or scalloped. There are two interior vertical side hip pockets for a cell phone and/or the aforementioned items that are sewn just below the waistband of the inner short, pant or Capri. Both pockets will accommodate a cell phone and the aforementioned items. These pockets keep the cell phone and the other aforementioned items securely retained within the pockets. The pockets are located at the sides of the shorts, pants or Capri of the user's hips, so that the cell phone and/or the aforementioned items can be carried inconspicuously, securely and comfortably. The cell phone and/or the aforementioned items will be kept stable and safely secured while maintaining accessibility to the items in the interior vertical side hip pockets.

Making comfortable, functional shorts, pants or Capris has always been a challenge. With the profusion of cell phones, and the transition of cell phones from a convenience to a necessity that have to be taken along during all activities, the additional challenge of how to effectively secure a cell phone inside shorts, pants or Capris has presented itself The prior art presents a number of attempts to solve this problem, but none that so effectively combine an effective container for a cell phone and/or the aforementioned items in an ideal location on the inner liner that is inside the shorts, pants or Capris. This particular combination has proven to result in an extremely comfortable and useful pair of shorts, pants or Capris that prevents the exerciser, hiker, golfer, traveler, athlete, sports enthusiast, runner, walker, or jogger from having the phone slap his/her thigh when the cell phone and/or the aforementioned items are contained in a pocket located on the individual's thigh; having to shove the cell phone into a woman's or girls' sports bra, which is potentially unhealthy; having to hold the cell phone in his/her hand, which can cause cramping or being strapped to a bicep, which is inconvenient and difficult, when trying to access the cell phone or music device, and can potentially reduce blood flow, create an unwanted rash, and could limit muscle contraction.

There are shorts, pants or Capris with reflective details, but these are mostly reflective patches that are glued or heat-affixed to the exterior of the shorts, pants or Capris. These tend to get damaged by washing and lose both their effectiveness and looks with every washing. These details are customarily the logo of the company and do not create visibility during low-visibility times for the exerciser, runner, sports enthusiast, athlete, golfer, traveler, hiker, walker or jogger.

There are also shorts, pants or Capris with cell phone pockets, but these are usually too small, have inadequate closure methods, or are located on a part of the shorts, pants or Capris where they are inaccessible and uncomfortable. The existing cell phone pockets are also not well secured, such that there is a danger of the entire pocket "flipping over" the waistband or out of other pocket locations, thus potentially causing the cell phone and/or the other aforementioned items to fall out, be sat on, banged, folded, or knocked.

Shorts, pants or Capris with elastic waistbands are well known, but the current invention combines an elastic waistband with a non-elasticized drawstring cord, such that the user can benefit from the comfort of an elastic waistband, but when he/she really needs to make sure the shorts, pants or Capris stay on, he/she can do by tightening them with the non-elasticized drawstring cord.

Shorts, pants or Capris with inner liners are also known in the art, but this invention has the built-in seamless "boy short" style underwear knitted without seams to enhance comfort, and serving a secondary function by anchoring the cell phone pocket to the shorts.

OBJECTS OF THE INVENTION

It is therefore an object of the present invention to provide a short, pants or Capris with pockets that securely, comfortably and safely accommodate and hold a cell phone, with easy accessibility, and an elasticized waistband that prevents the shorts, pants or Capris from falling down, while wearing the shorts, pants or Capris, with a seamless "boy short" underwear as an inner liner, with reflective fabric on the hems and sides of hips.

Further objects of the invention include:

Providing shorts, pants or Capris with an effective inner liner that does not bunch up at the intersection of the legs and the body.

Providing a short, pants or Capris with a boy's short underwear inner layer that has been knitted to be seamless.

Providing a short, pants or Capris with a non-elasticized, continuous interior drawstring cord.

Providing a short, pants or Capris with thin strips of reflective fabric sewn onto the hips and hem of the shorts.

Providing shorts, pants or Capris with cell phone pockets large enough for a large cell phone, located at the side of the shorts and the hips of the wearer, where the pockets are sewn onto the inner liner.

Providing shorts, pants or Capris with a straight or scalloped hem.

There has thus been outlined, rather broadly, the more important features of the invention in order that the detailed description thereof may be better understood, and in order that the present contribution to the art may be better appreciated. There are additional features of the invention that will be described hereinafter and which will form the subject matter of the claims appended hereto. The features listed herein and other features, aspects and advantages of the present invention will become better understood with reference to the following description and appended claims. The accompanying drawings, which are incorporated in and constitute part of this specification, illustrate embodiments of the invention and, together with the description, serve to explain the principles of the invention.

It should be understood the while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

BRIEF DESCRIPTION OF THE DRAWINGS

Two preferred forms of the invention will now be described with reference to the accompanying drawings.

Figure 1:
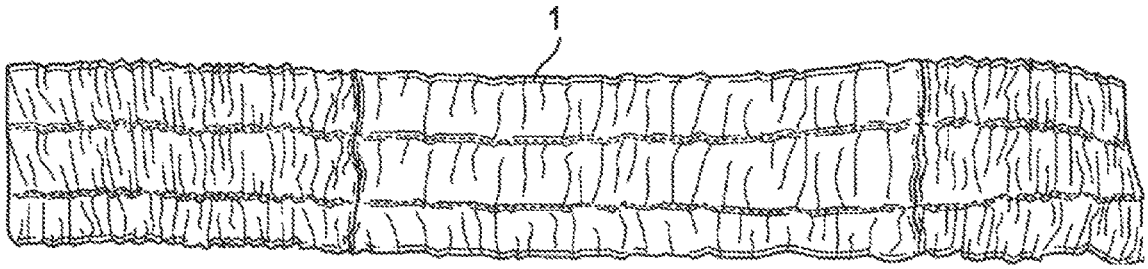
FIG. 1 is front view of the elasticized waistband portion of the invention.

1. Elasticized waistband
2. Non-elasticized drawstring cord
3. Channel inside elasticized waistband
4. Keyhole opening
5. Reflective fabric
6. Inner layer seamless "boy short" style underwear
7. Pocket
8. Pocketbody
9. Pocket opening
10. (Left blank on purpose)
11. Scalloped seam
12. insertable container, pouch or wallet
13. Cell phone
14. Leg Portion

DETAILED DESCRIPTION OF THE INVENTION

Many aspects of the invention can be better understood with references made to the drawings below. The components in the drawings are not necessarily drawn to scale. Instead, emphasis is placed upon clearly illustrating the components of the present invention. Moreover, like reference numerals designate corresponding parts through the several views in the drawings.

Before explaining at least one embodiment of the invention, it is to be understood that the embodiments of the invention are not limited in their application to the details of construction and to the arrangement of the components set forth in the following description or illustrated in the drawings. The embodiments of the invention are capable of being practiced and carried out in various ways. In addition, the phraseology and terminology employed herein are for the purpose of description and should not be regarded as limiting.

FIG. 1 is a front view perspective of the elasticized waistband portion of the invention. The elasticized waistband 1 is roughly 2 to 3 inches in height, with an outer surface and an inner surface, stitched together at the base to form a hollow channel between the outer surface and the inner surface.

Figure 2:
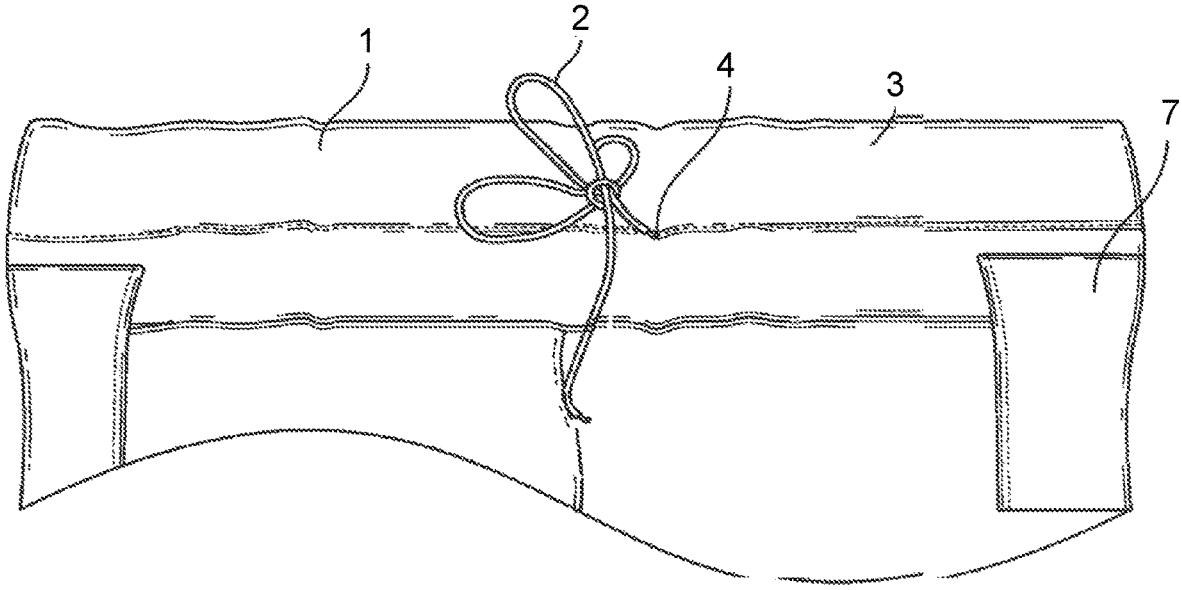
FIG. 2 is a front view of the non-elasticized, continuous interior drawstring cord.

FIG. 2 is a front inside-out view perspective of the non-elasticized, continuous interior drawstring cord. The drawstring cord 2 is movably embedded in the channel between the outer surface and the inner surface of the elasticized waistband 1. The ends of the drawstring cord extend through two keyhole openings 4 to allow a user of the invention to tighten the shorts as needed. One each side of the interior of the shorts is a pocket 7 which is attached on the inside of the seamless boy short underwear, referred to as the inner liner or inner layer.

Figure 3:
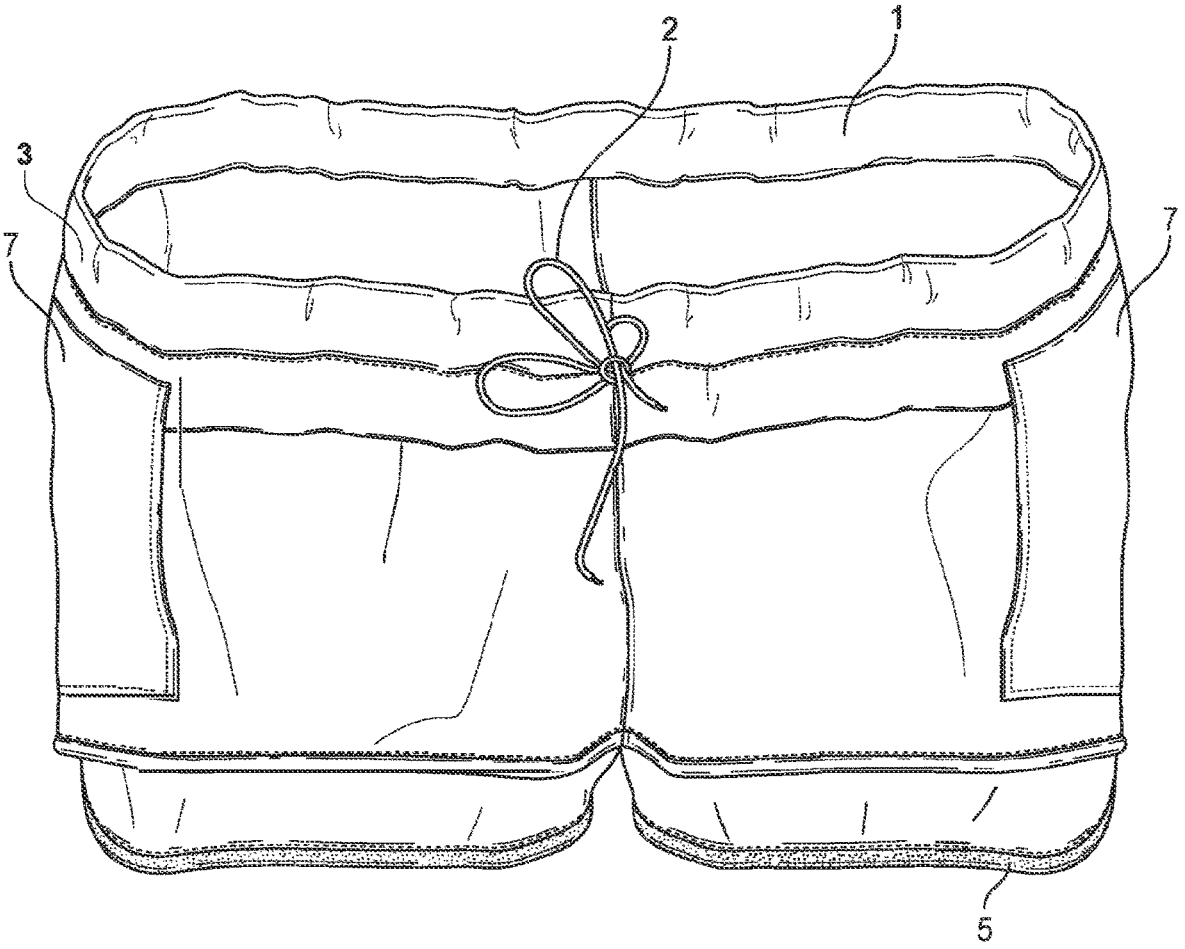
FIG. 3 is a perspective view of the interior pockets on each hip which are situated below the elasticized waistband and sewn on the built-in, seamless "boy short" style underwear with a non-elasticized, continuous interior drawstring cord and reflective fabric sewn on the hem and sides of the shorts.

FIG. 3 is an inside-out perspective view of the interior pockets on each hip which are situated below the elasticized waistband and sewn on the built-in, seamless "boy short" style underwear, with a non-elasticized, continuous interior drawstring cord and reflective fabric sewn on the hem and sides of the outer shorts. Reflective fabric 5, is sewn into the intersection of the front and back panels at each hip, and along the bottom hem of the shorts. This reflective fabric is superior to the prior art that teaches applying a reflective glue or overlay, which will sooner or later get destroyed during the washing of the garment. The reflective tape serves to alert cars, bicyclists, and even other exercisers, walkers, joggers, hikers, golfers, or runners during low visibility times by providing a reflective glare from his/her front side, backside, and side of hips. As can be seen in this illustration, pockets 7 are relatively wide and long-indeed, wide enough and long enough to hold a cell phone and/or other small items.

Figure 4:
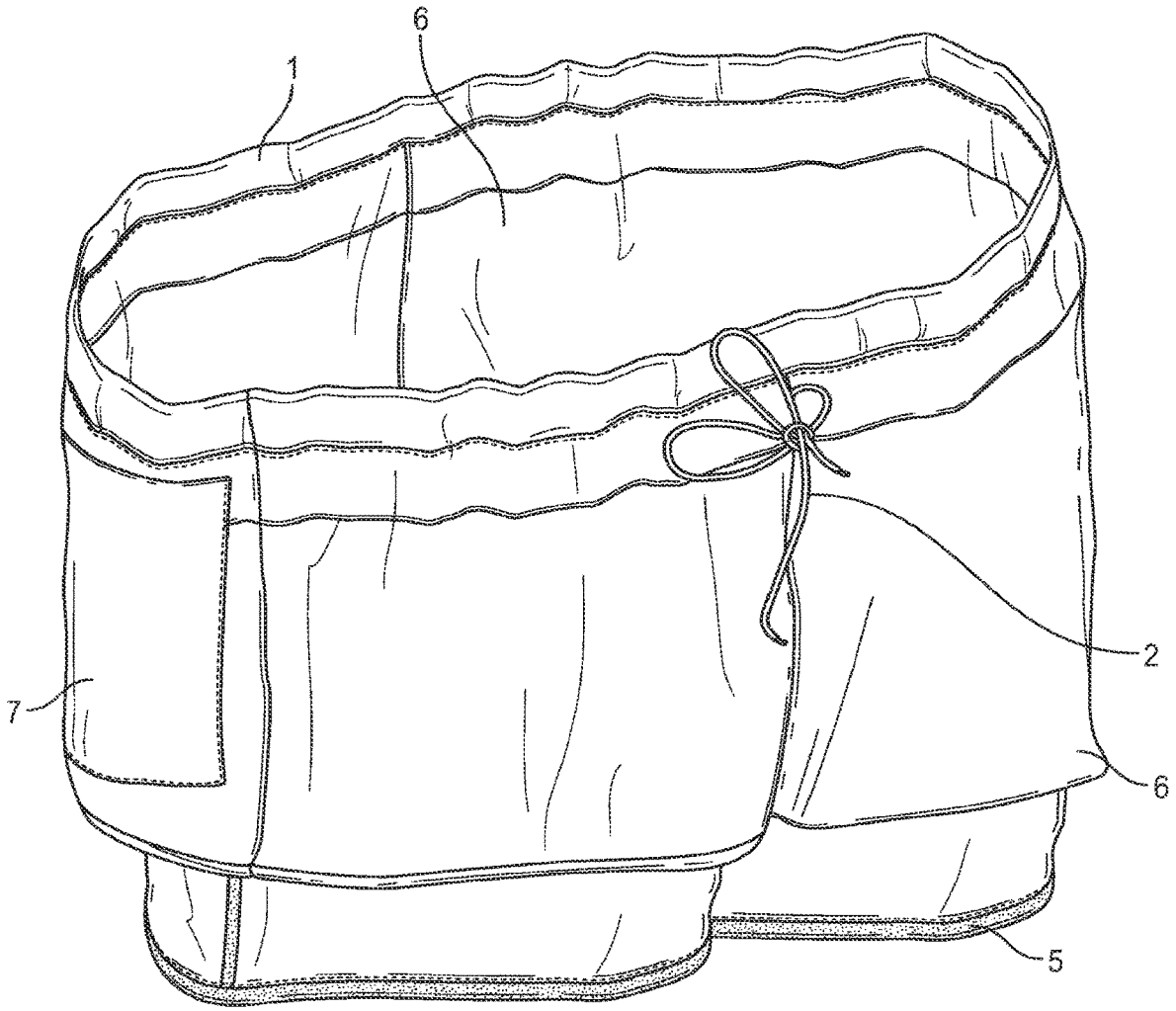
FIG. 4 is another perspective view of the interior pockets on each hip which are situated below the elasticized waistband and sewn on the built-in, seamless "boy short" style underwear with a non-elasticized, continuous interior drawstring cord and reflective fabric sewn on the hem and sides of the shorts.

FIG. 4 is another inside-out perspective view of the interior pockets on each hip which are situated below the elasticized waistband and sewn on the built-in, seamless "boy short" style underwear with a non-elasticized, continuous interior drawstring cord and reflective fabric sewn on the hem and sides of the shorts. To enhance the comfort of the invention, an inner layer 6 is provided. The inner layer is like a "boy short" style underwear garment portion 6, which is seamless, where it snugly fits around the lower torso of the user, but ends at the intersection of the torso and the legs, so that it doesn't bunch up, stretch or chafe as the user walks, runs, jogs, golfs, hikes, or exercises. This inner layer 6 is knitted to avoid any seams, thereby making it more comfortable for the wearer. The interior pockets 7 are sewn slightly below the inside of the elasticized waistband 1 and to the inner layer 6, thereby making it solidly attached at both ends to the garment. This minimizes the effects on the items in the pockets 7 from excessive movements such as swinging back-and-forth, side to side and up and down while reducing potential damage to the cell phone and/or the items contained in the pockets. By placing the interior pockets 7 at the hips of the user of the invention, the prior art problem of cell phones placed in pockets at the front of the shorts and jabbing the user with every step are solved. The prior art problem of a person losing a cell phone from an exterior pocket through either pick-pocketing or just having the cell phone fall out is also solved by locating the pockets on the inner liner of the shorts. The interior pocket placement maintains a smooth, sleek look and feel as the items are secured more comfortably and inconspicuously.

Figure 5:
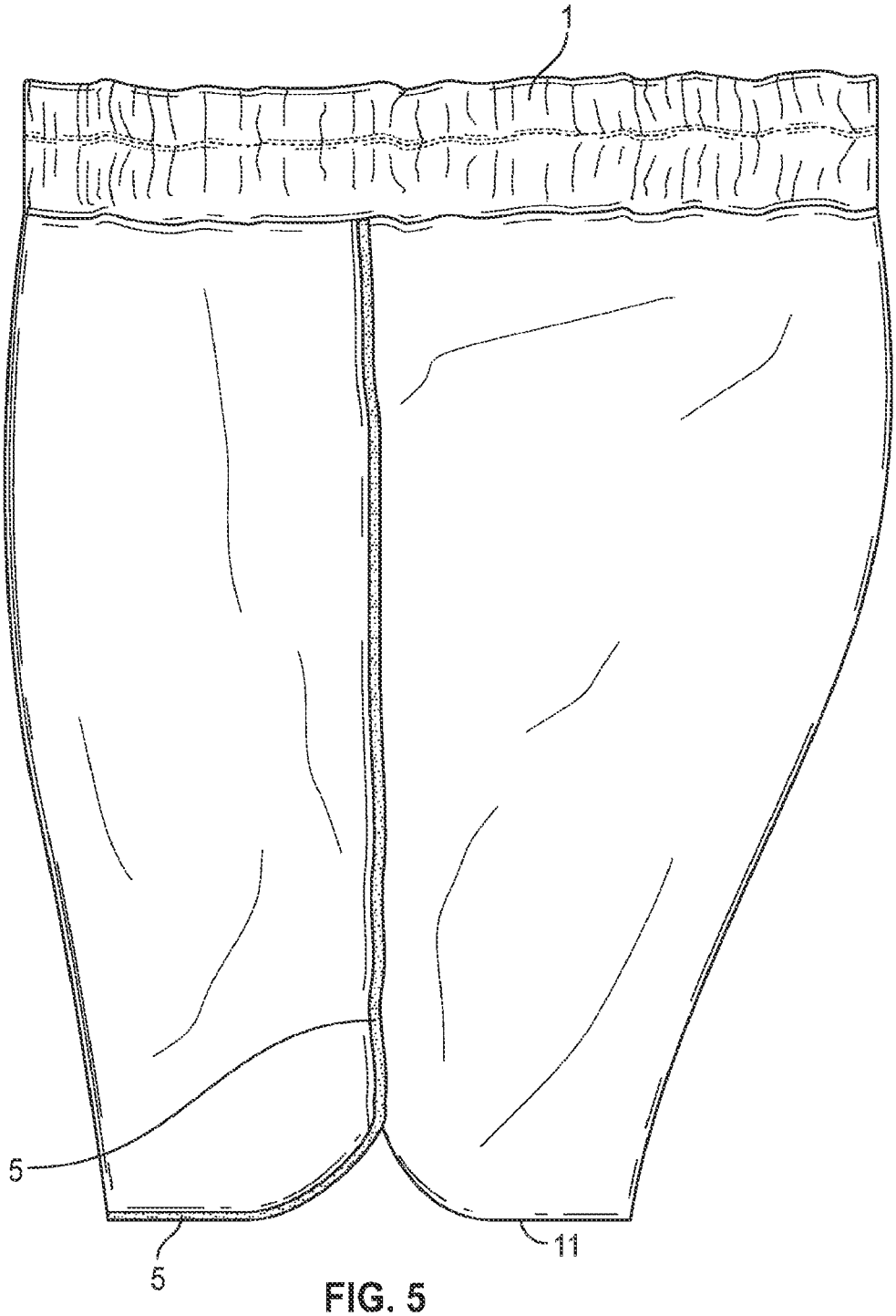
FIG. 5 is a perspective view of the hem of the short, which can be straight or scalloped with reflective fabric on the side of the hip and the hem of the shorts.

FIG. 5 is a side view of the hem of the short, which can be straight or scalloped 11, trimmed in reflective fabric 5 on the side of the hip and the hem of the shorts.

Figure 6:
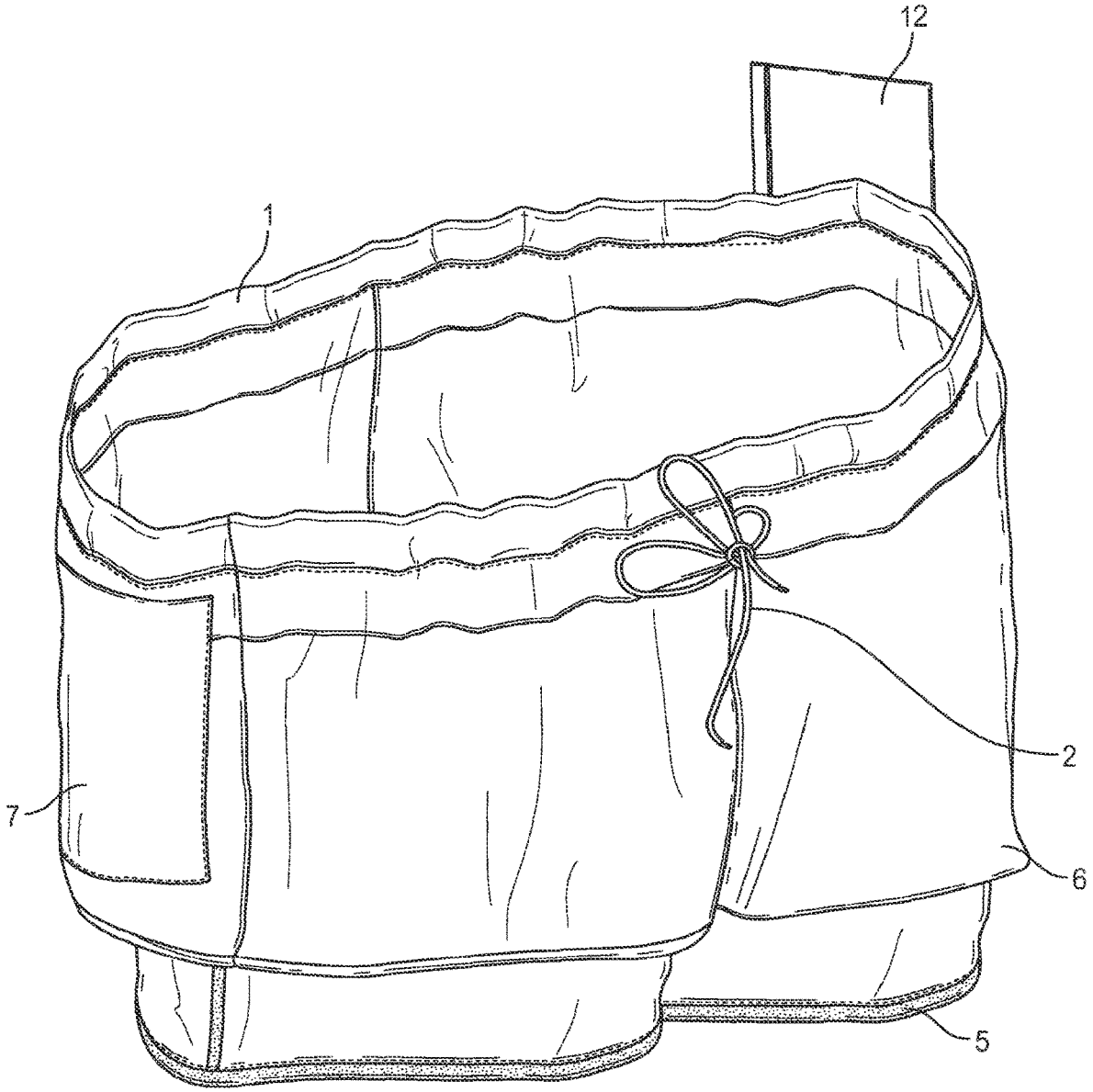
FIG. 6 is a front perspective view of the shorts showing the location of the two interior pockets on the side of the shorts and hips of the user, and how a user can slide a slim insertable container, pouch or wallet and/or other items into either one of the pockets.

FIG. 6 is a front, inside-out perspective view of the shorts showing the location of the two interior pockets 7 on the side of the shorts and hips of the user, and how a user can slide a slim insertable container, pouch or wallet 12 (or another similarly shaped item) into one of the pockets. The insertable container, pouch or wallet 12 can house an ID, credit card, keys, medical information, and/or any other slim items that a user of the invention may wish to put in the container, pouch or wallet.

Figure 7:
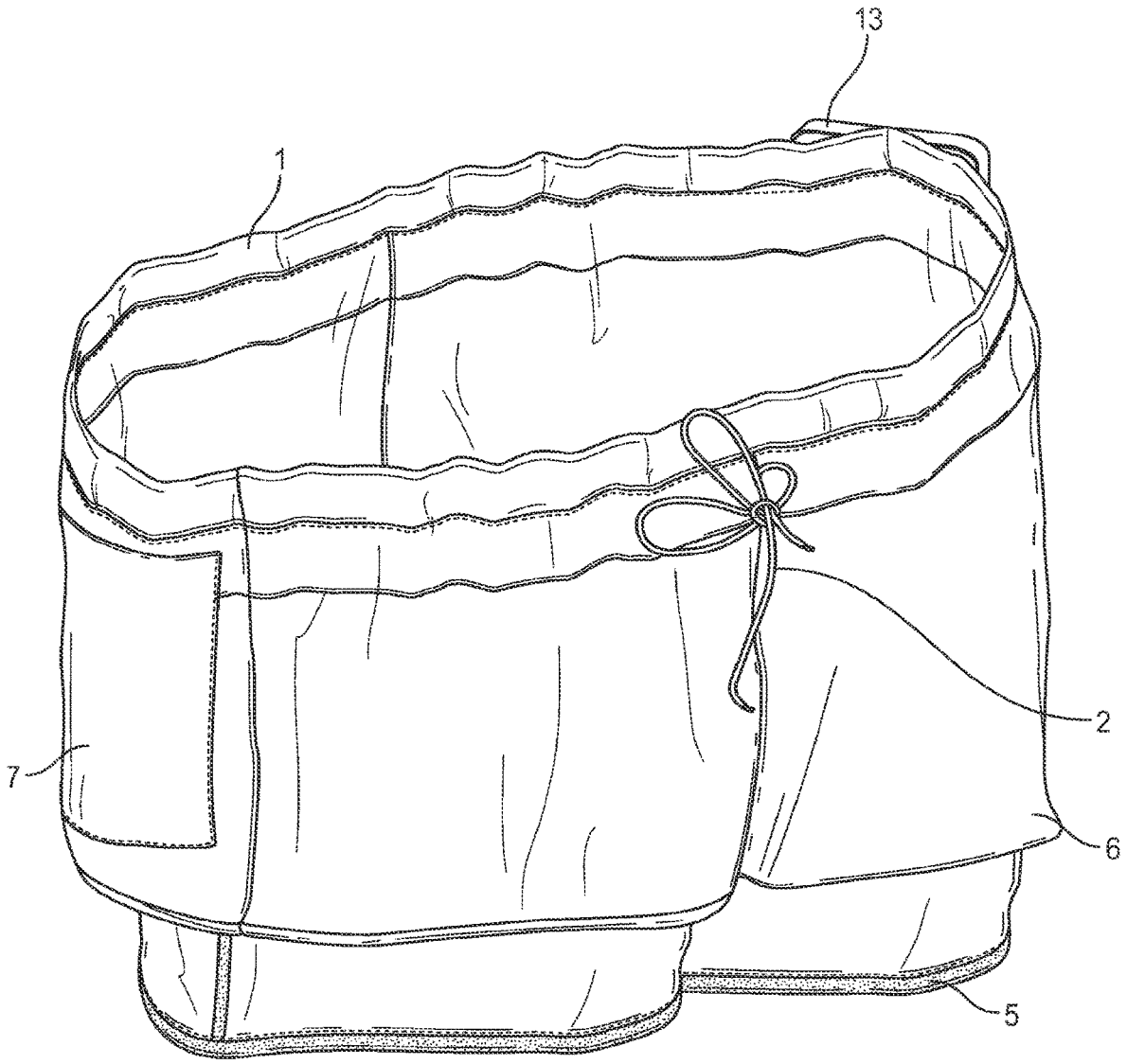
FIG. 7 is a front perspective view of the shorts showing the location of the two interior pockets on the sides of the shorts and hips of the user of the shorts, and how a user can slide a cell phone into either one of the pockets.

FIG. 7 is a front, inside-out perspective view of the shorts showing the location of the two interior pockets 7 on the hips of the user and the sides of the shorts, exemplifying how a user can slide a cell phone 13 into either one of the pockets. After inserting the cell phone 13 in to the pocket 7, the pocket helps to retain the cell phone and/or other item(s).

Figure 8:
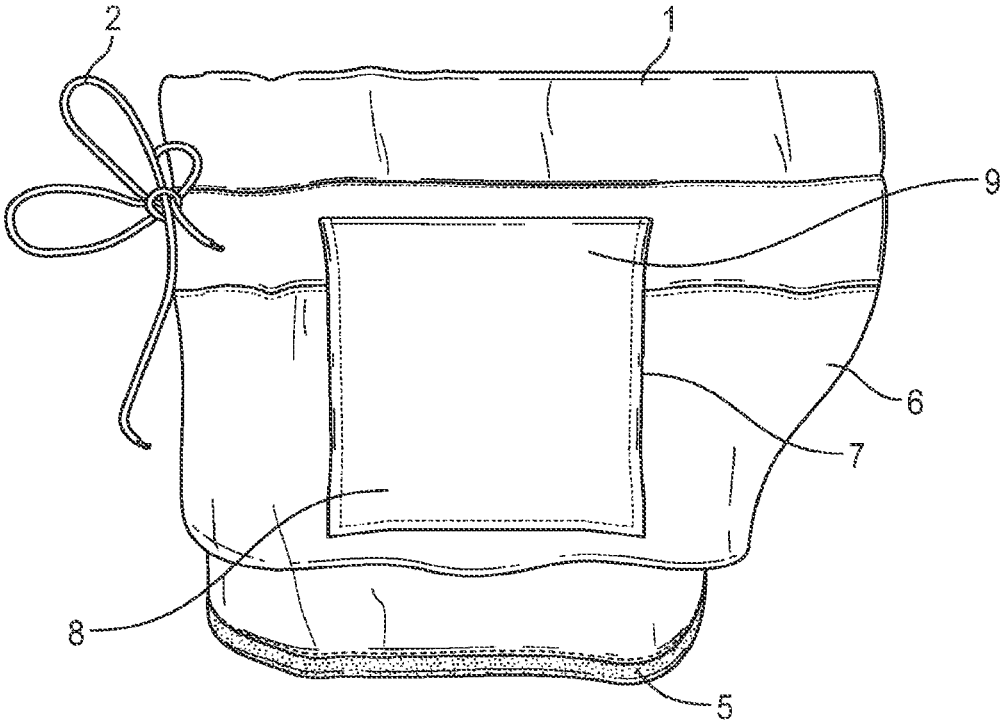
FIG. 8 is a side view of the shorts after they have been turned inside out, showing the location of the pocket on the hip of the short.

FIG. 8 is a side inside-out view of the shorts after they have been turned inside out, showing the location of the interior pocket 7 on the side of the short and the hips of the user. The pocket 7, with a pocket body 8 and a pocket opening 9, is sewn to the inside of the inner liner of the inner layer boy short style seamless underwear 6 just below the elasticized waistband 1 so that it is secure and will not bounce around when a user of the invention runs, walks, jogs, hikes, golfs or exercises with it.

Figure 9:
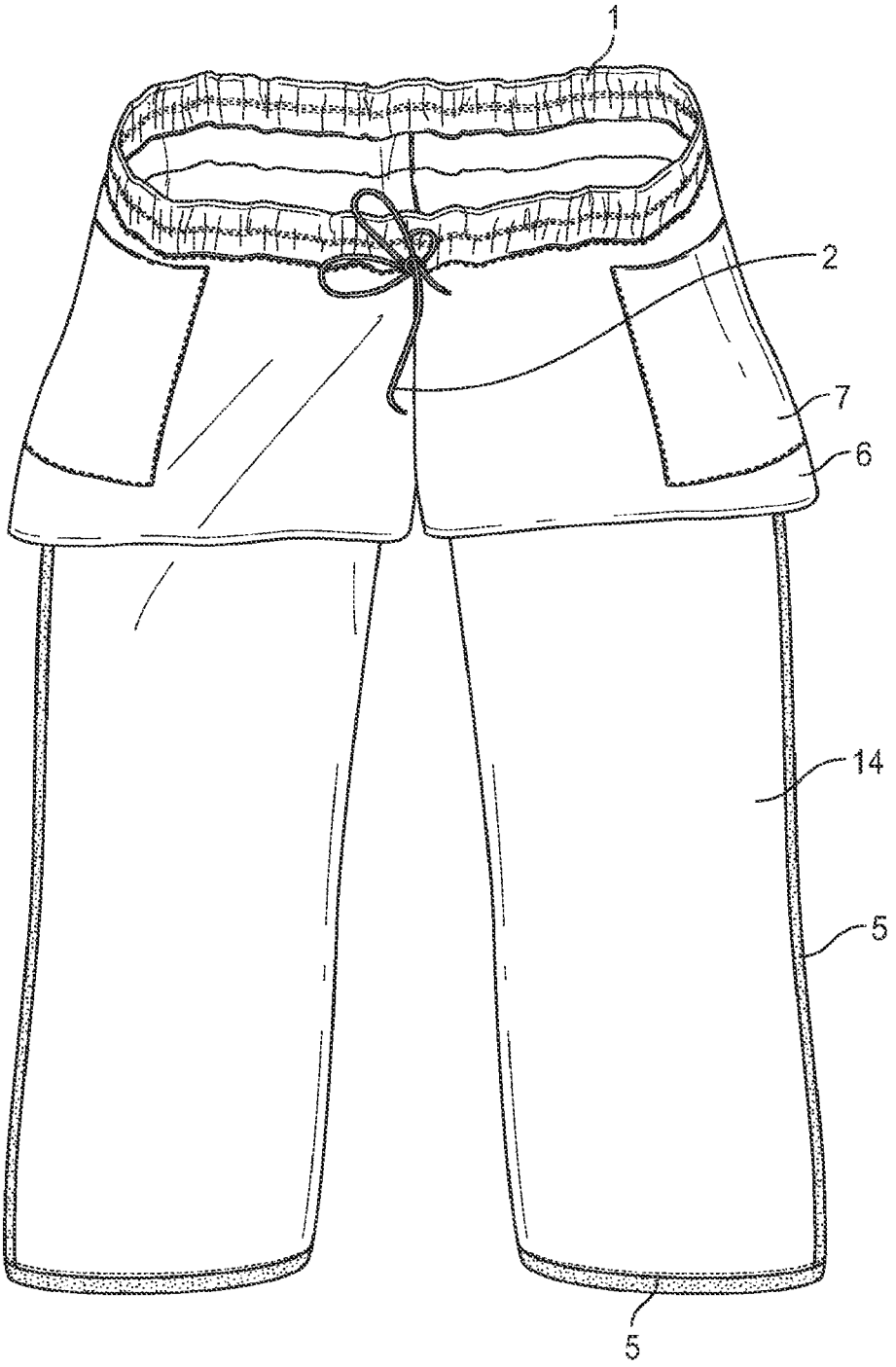
FIG. 9 is a front view of another embodiment of the invention with longer leg portions, turned inside out.

FIG. 9 is a front view of another embodiment of the invention with longer leg portions 14, turned inside-out. The basic concept behind the invention is preserved, with an elastic waistband 1, two pockets 7, and a comfortable seamless boy short style underwear inner liner 6. In this embodiment, the reflective layer 5 is sewn along both the sides and bottom of the leg portions.

Figure 10:
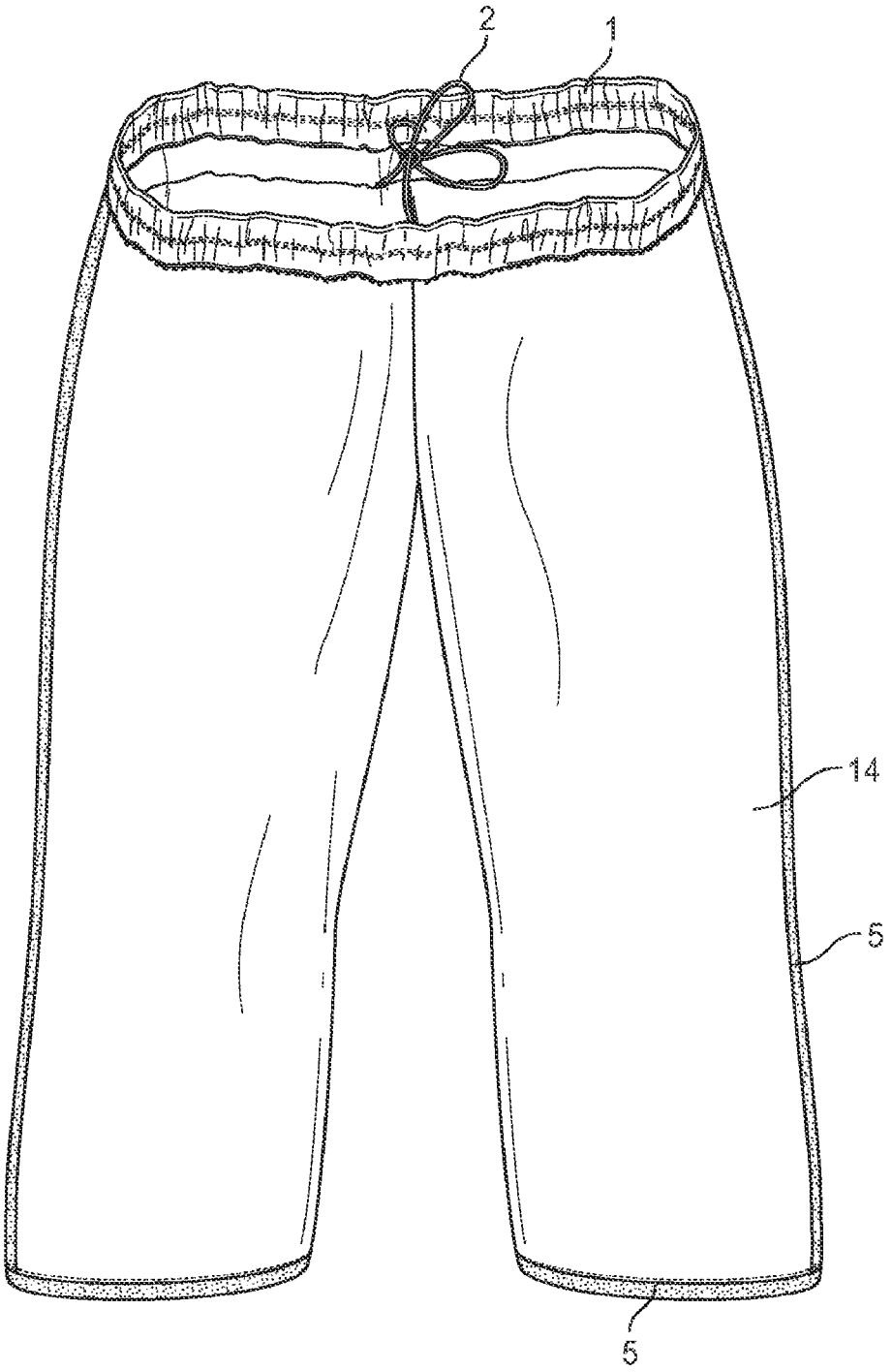
FIG. 10 is a front view of the embodiment of the invention illustrated in FIG. 9, but not turned inside out. Reference Numbers used

FIG. 10 is a front view of the embodiment of the invention illustrated in FIG. 9, but not turned inside out. The leg portions 14 allow a user to stay warmer than with the shorts version previously described, and the longer reflective fabric 5 provides greater visibility for the user of the invention should he/she be out at night.

It should be understood that while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

What is claimed is:

1. Apparel configured for all genders, ages and sizes for securely carrying an electronic device and/or other small items at the hips of a user while the apparel is worn on the user's waist to at least partially cover the user's lower torso and legs below the user's waist, the apparel comprising:

a waistband configured to secure the apparel to the user's waist; and shorts, pants or capris extending from the waistband and sized and configured to at least partially cover the user's lower torso and legs below the user's waist, the shorts, pants or capris comprising:

an outer layer connected to and extending below the waistband, the outer layer having a lower hem that extends at least partially over the user's legs;

an inner layer connected to and extending below the waistband proximate the inner face of the waistband, and being sized and configured to fit snugly on the user's lower torso, the inner layer having an inner surface that fits against the user's lower torso and an outer surface that faces the outer layer of the shorts, pants or capris; and one or more pockets attached to the inner surface of the inner layer, each of the one or more pockets comprising a front panel defined by a pocket bottom and pocket sides that are attached to the inner surface of the inner layer, and having a top opening that is accessible only from the inner surface of the inner layer, the top opening being sized and configured to receive the electronic device and/or other small items, each of the one or more pockets being attached to the inner surface of the inner layer below and spaced apart from the bottom of the waistband, each of the one or more pockets being sized and positioned on the inner surface of the inner layer to cooperate with the inner layer for carrying the electronic device and/or other small items snugly at the hips of the user.

2. Apparel in accordance with claim 1, wherein the inner layer is comprised of a knitted and seamless material.

3. Apparel in accordance with claim 1, wherein the pocket bottom and pocket sides of each of the one or more pockets are sewn to the inner surface of the inner layer.

4. Apparel in accordance with claim 1, wherein an outer surface of the outer layer includes a reflective material.

5. Apparel in accordance with claim 4, wherein the outer layer includes one or more seams that join two panels of material that form the outer layer, and wherein the reflective material is affixed to the outer surface of the outer layer along at least some of the seams and/or lower hem.

6. Apparel in accordance with claim 1, wherein the waistband further comprises an elasticized portion.

7. Apparel in accordance with claim 1, wherein the waistband includes at least one eyelet hole, and a drawstring provided between the inner face and outer face, the drawstring having two end sections that extend from the waistband through the at least one eyelet hole.

8. Apparel in accordance with claim 1, wherein the inner layer is sized and configured such that the inner layer does not cause chafing while the apparel is worn by the user.

9. Apparel configured for all genders, ages and sizes for securely carrying an electronic device and/or other small items at the hips of a user while the apparel is worn on the user's waist to at least partially cover the user's lower torso and legs below the user's waist, the apparel comprising:

shorts, pants or capris extending from a waistband that is configured to secure the apparel to the user's waist, the shorts, pants or capris being sized and configured to at least partially cover the user's lower torso and legs below the user's waist, the shorts, pants or capris comprising:

an outer layer connected to and extending below the waistband, the outer layer having a lower hem that extends at least partially over the user's legs;

an inner layer connected to and extending below the waistband proximate the inner face of the waistband, and being sized and configured to fit snugly on the user's lower torso, the inner layer having an inner surface that fits against the user's lower torso and an outer surface that faces the outer layer of the shorts, pants or capris; and one or more pockets attached to the inner surface of the inner layer, each of the one or more pockets comprising a front panel defined by a pocket bottom and pocket sides that are attached to the inner surface of the inner layer, and having a top opening that is accessible only from the inner surface of the inner layer, the top opening being sized and configured to receive the electronic device and/or other small items, each of the one or more pockets being attached to the inner surface of the inner layer below and spaced apart from the bottom of the waistband, each of the one or more pockets being sized and positioned on the inner surface of the inner layer to cooperate with the inner layer for carrying the electronic device and/or other small items snugly at the hips of the user.

10. Apparel in accordance with claim 9, wherein the apparel is sized and configured to at least partially cover the user's lower torso and legs below the user's waist.

11. Apparel in accordance with claim 9, wherein the inner layer is comprised of a knitted and seamless material.

12. Apparel in accordance with claim 9, wherein the pocket bottom and pocket sides of each of the one or more pockets are sewn to the inner surface of the inner layer.

13. Apparel in accordance with claim 9, wherein an outer surface of the outer layer includes reflective material.

14. Apparel in accordance with claim 13, wherein the outer layer includes one or more seams that join two panels of material that form the outer layer, and wherein the reflective material is affixed to the outer surface of the outer layer along at least some of the seams and/or lower hem.

15. Apparel in accordance with claim 9, wherein the waistband further comprises an elasticized portion.

16. Apparel in accordance with claim 9, wherein the waistband includes at least one eyelet hole, and a drawstring provided between the inner face and outer face, the drawstring having two end sections that extend from waistband through the at least one eyelet hole.

17. Shorts, pants or capris for securely carrying an electronic device and/or other small items at one or both hips of a user while being worn by the user, the shorts, pants or capris comprising:

an outer layer having a lower hem that extends at least partially over the user's legs;

an inner layer connected to an inner surface of the outer layer, and being sized and configured to fit snugly on the user's lower torso, the inner layer having an inner surface that fits against the user's lower torso and an outer surface that faces the inner surface of the outer layer of the shorts, pants or capris; and one or more pockets attached to the inner surface of the inner layer, each of the one or more pockets comprising a front panel defined by a pocket bottom and pocket sides that are attached to the inner surface of the inner layer, and having a top opening that is accessible only from the inner surface of the inner layer, the top opening being sized and configured to receive the electronic device and/or other small items, each of the one or more pockets being attached to the inner surface of the inner layer below and spaced apart from a top of the inner layer, each of the one or more pockets being sized and positioned on the inner surface of the inner layer to cooperate with the inner layer for carrying the electronic device and/or other small items snugly at the hips of the user.

18. Shorts, pants or capris in accordance with claim 17, further comprising a waistband having a top and being configured to secure the shorts, pants or capris to the user's waist.

19. Shorts, pants or capris in accordance with claim 17, wherein the inner layer is comprised of a knitted and seamless material.

20. Shorts, pants or capris in accordance with claim 17, wherein an outer surface of the outer layer includes reflective material.

* * * * *